United States Patent [19]

Schaenzer

[11] 4,189,980

[45] Feb. 26, 1980

[54] METHOD AND APPARATUS FOR RELOADING A CENTERFIRE CARTRIDGE

[76] Inventor: Gordon N. Schaenzer, 11737 N. Solar Ave., Mequon, Wis. 53092

[21] Appl. No.: 869,822

[22] Filed: Jan. 16, 1978

[51] Int. Cl.[2] ..... F42B 33/00

[52] U.S. Cl. ..... 86/24; 86/33; 86/37; 86/40; 86/43

[58] Field of Search ..... 86/23–39, 86/44, 43

[56] References Cited

U.S. PATENT DOCUMENTS

| | | | |
|---|---|---|---|
| 1,502,824 | 7/1924 | Hueter | 86/23 |
| 3,134,293 | 5/1964 | Lee | 86/24 |
| 3,408,892 | 11/1968 | Smith et al. | 86/38 X |
| 3,580,127 | 5/1971 | Lee | 86/24 |
| 3,974,736 | 8/1976 | Minko | 86/23 |

OTHER PUBLICATIONS

"Lee Target Model Loader fo Rifle Cartridges".

*Primary Examiner*—Harold J. Tudor
*Attorney, Agent, or Firm*—Quarles & Brady

[57] ABSTRACT

A method and apparatus for reloading a centerfire cartridge, the apparatus including a resizing die for resizing the cartridge and a single means for forcing a used primer out of the cartridge and for forcing the cartridge out of the resizing die. A flaring tool is then used to flare the cartridge neck and a priming tool is employed to force a primer into the base of the cartridge. Gunpowder is then placed in the cartridge, a new bullet is forced into the cartridge neck, and the cartridge neck is then crimped against the bullet.

6 Claims, 12 Drawing Figures

METHOD AND APPARATUS FOR RELOADING A CENTERFIRE CARTRIDGE

BACKGROUND OF THE INVENTION

1. Field of the Invention

The present invention relates to an improved apparatus for reloading centerfire cartridges.

2. Description of the Prior Art

Numerous reloading devices and kits for reloading centerfire cartridges are suggested by the prior art, but the majority of these reloaders generally comprise bench supported presses or machines and are relatively expensive. Reloading of cartridges is advantageous to sportsmen by reducing the cost of cartridges. However the economic effect of reloading cartridges is substantially limited if the reloading equipment required is complicated and expensive.

Some other prior art reloaders have provided a relatively inexpensive means for reloading cartridges. Such reloaders are shown in U.S. Pat. No. 3,134,293 issued May 26, 1964, to Lee; U.S. Pat. No. 3,580,127 issued May 25, 1971 to Lee; and in the publication entitled "Lee Target Model Loader for Rifle Cartridges," and published by Lee Custom Engineering Company. Such reloaders generally include a substantial number of hand held tools for performing numerous required steps in reloading cartridges.

SUMMARY OF THE INVENTION

The present invention provides an improved apparatus for manually reloading cartridges the apparatus providing a safer means for reloading cartridges than those commonly practiced, and the apparatus consisting of fewer components and accordingly being less expensive to manufacture.

The means of reloading a cartridge using the apparatus of the invention generally includes the following steps. A resizing die is forced onto a cartridge to resize its entire length. A depriming rod is then used to knock the spent primer out of the cartridge base and immediately thereafter to remove the resized cartridge from the resizing die. A flaring tool is then employed to flare the cartridge neck, and a priming tool is used to force a new primer into the primer bore in the cartridge. The resizing die is then placed loosely over the cartridge and functions as a funnel to permit gunpowder to be poured into the cartridge. A bullet is then dropped into the flared shell neck and forced into the proper position using a bullet seating tool. Finally, a crimping tool is then used to crimp the neck of the cartridge around the bullet.

Using the apparatus of the invention, cartridge reloading is safer than when using prior art apparatus such as that shown in U.S. Pat. No. 3,134,293 wherein a knock-out rod is inserted into the cartridge to be used to knock the cartridge out of the sizing die when the cartridge houses an explosive primer. The method and apparatus of the invention facilitates safer reloading than the prior art means because the cartridge is resized before a new explosive primer is inserted into the primer bore of the cartridge. Accordingly there is no possibility that the primer could accidently discharge when the cartridge is forced into the resizing die or when it is knocked out. A further advantage of the invention is that the apparatus includes fewer components and therefore is both less expensive and easier to use. For example, the depriming tool can also be used to knock the resized cartridge out of the resizing die.

DESCRIPTION OF THE PREFERRED EMBODIMENT

Figure 1:
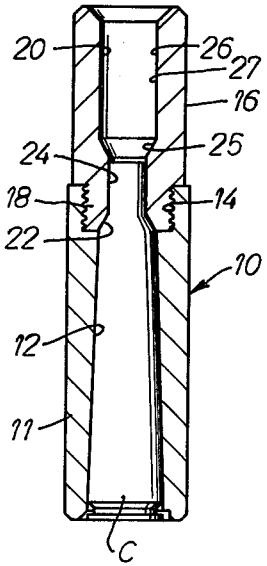
FIG. 1 is a cross section elevation view of the resizing die of the cartridge reloader of the invention with a cartridge shown therein.

Referring to FIG. 1 of the drawings it will be seen that the reloading apparatus includes a resizing die 10 comprised of a neck sizing portion 16 and a cartridge body sizing portion 11 threadably secured together. The cartridge body sizing portion 11 includes a longitudinal bore 12 therethrough for receiving a cartridge C as shown. The longitudinal bore 12 of the sizing portion 11 also includes an enlarged threaded upper end portion 14 receiving the cylindrical neck sizing portion 16 having a lower threaded neck portion 18 threadably engaged in the enlarged threaded upper end portion 14 of the longitudinal bore 12. The neck sizing portion 16 is provided with a longitudinal central axially entending bore 20 axially aligned with longitudinal bore 12 and adapted to register with bore 12. The lower end portion of the longitudinal bore 20 tapers upwardly and inwardly to form a shoulder 22. Above the shoulder 22 is a generally cylindrical bore portion 24 functional to resize the neck of cartridge C when the cartridge C is forced into the resizing die 10 during the first step of the cartridge reloading process. The longitudinal bore 20 further includes an enlarged funnel portion 26 above the bore portion 24, the funnel portion having an outwardly tapering portion 25 and a cylindrical portion 27 having a diameter larger than that of the bore neck portion 24.

The first step of the cartridge reloading process using the apparatus of the present invention comprises placing the resizing die 10 over a vertically positioned cartridge and tapping the upper end of the resizing die 10 with a rubber mallet or the like, until the resizing die is forced down over the cartridge C in the manner shown in FIG. 1 to thereby resize the outside configuration of the cartridge C.

Figure 3:
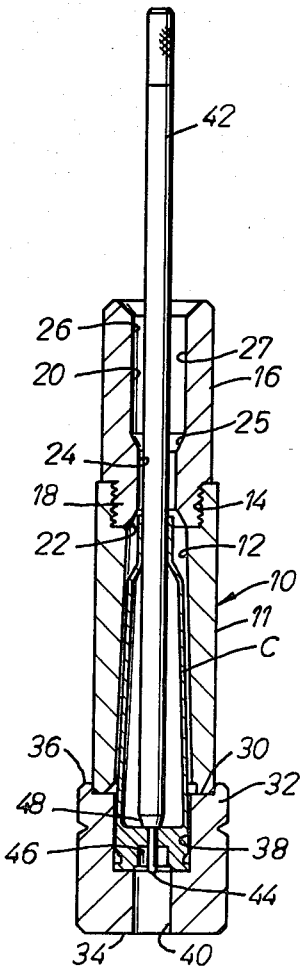
Figure 2:
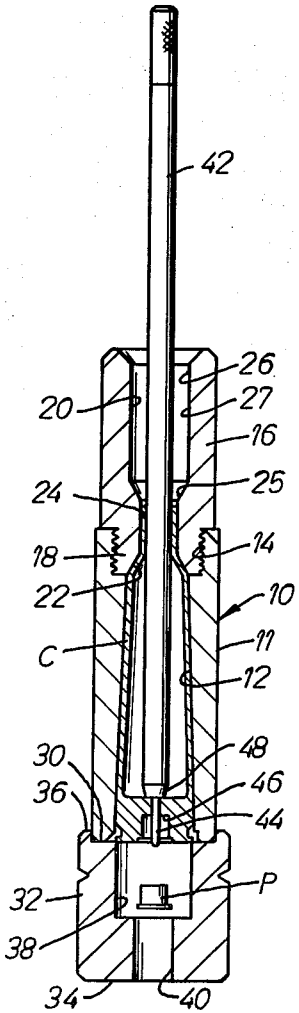
FIG. 2 is a cross section view of the resizing die shown in FIG. 1 positioned in an anvil and showing a depriming tool received in the cartridge for removing the spent primer from the cartridge.

The second and third steps of the cartridge reloading process are illustrated in FIGS. 2 and 3. The cylindrical resizing die 10 is positioned with its lower end in a supporting seat 30 of a cylindrical anvil 32. The anvil 32 has a flat supporting bottom surface 34 and a top face 36 with the circular supporting seat 30 formed therein. The cylindrical anvil is generally intended to permit a spent primer P to be knocked out of the cartridge C and the cartridge C to be subsequently pushed downwardly out of the resizing die 10. The anvil 32 includes a central bore 38 extending downwardly from seat 30 and having a diameter slightly larger than that of the cartridge base and intended to receive the cartridge base as the cartridge is forced out of the resizing die 10. A smaller diameter concentric bore 40 extends downwardly from the lower end of central bore 38, the bore 40 intended to receive a spent primer forced out of the cartridge C as shown in FIG. 2.

Figure 4:
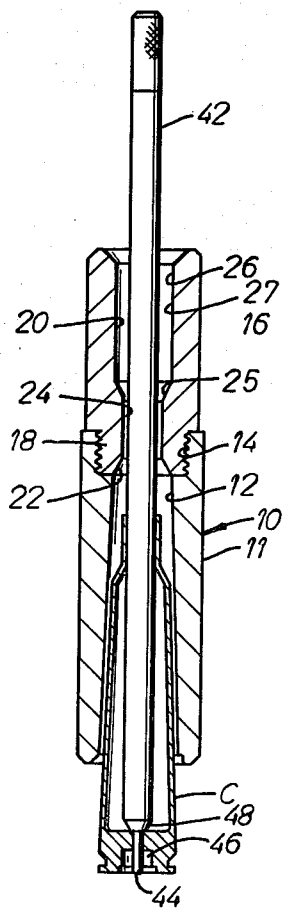
FIGS. 3 and 4 are similar to FIG. 2 but showing the cartridge removed from the resizing die.

Removal of the primer P from the cartridge C and removal of the cartridge C from the shell guide 10 is accomplished by an elongated rod 42 adapted to be inserted into the funnel portion 26 of the longitudinal bore 20 and into the open neck of the cartridge C when the resizing die 10 is supported by the anvil 32. The lower end of elongated rod 42 includes an integrally attached axially extending primer knockout pin 44 designed to fit into and through the primer bore 46 of the cartridge C whereby downward force on the elongated rod 42 causes the primer P to be knocked out of the cartridge C. The elongated rod 42 also includes a shoulder portion 48 adjacent pin 44, the shoulder 48 to be received against the cartridge base (FIG. 3) as the pin 44 is received within the primer bore 46. Continued downward force on the elongated rod 42 frees the cartridge from the resizing die 10. The cartridge may then be easily removed from the resizing die 10 as shown in FIG. 4.

Figures 5, 6, 7, 8, 9:
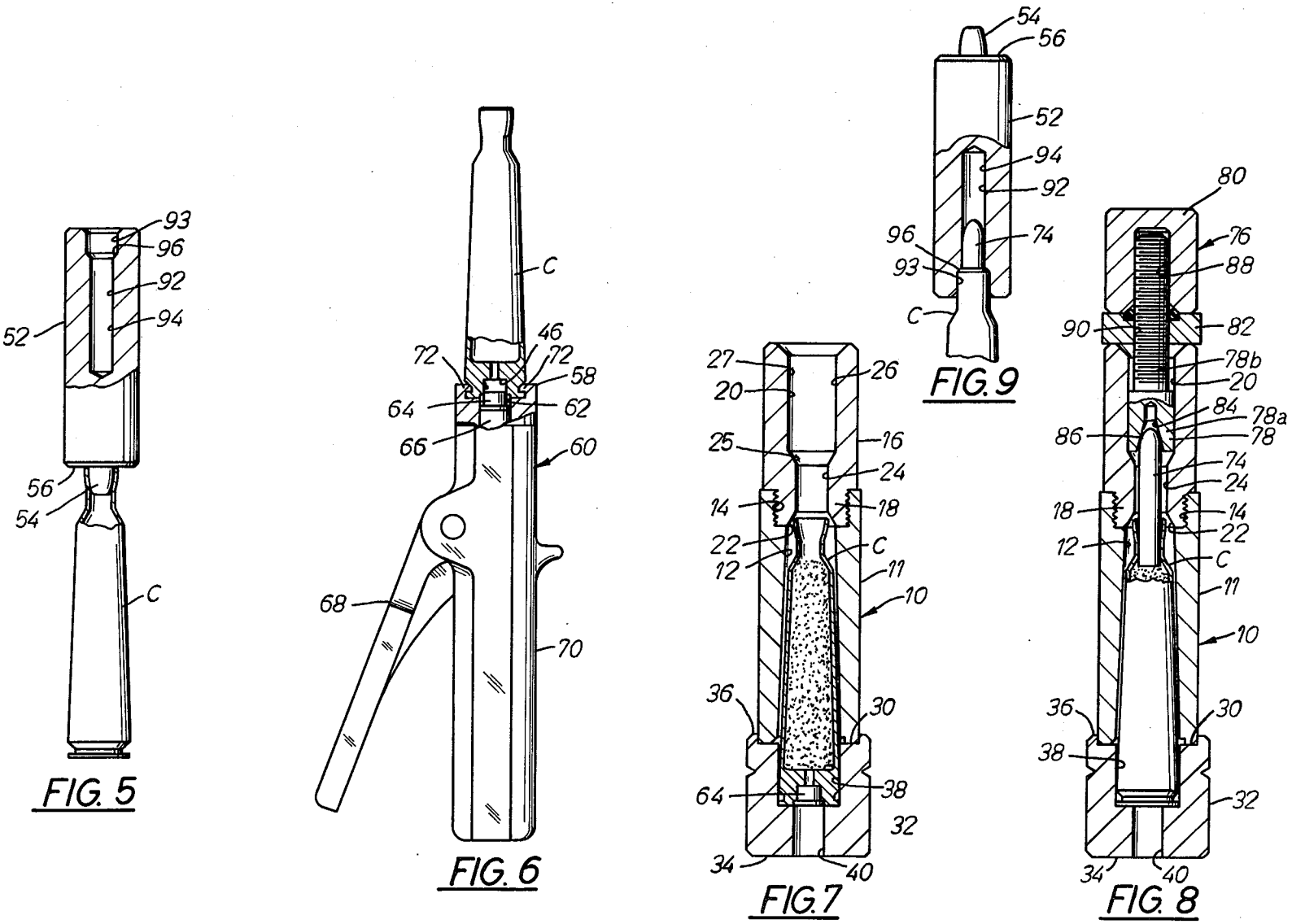
FIG. 5 is an elevation view of the crimping and flaring tool of the cartridge reloading tool of the invention with portions broken away in the interest of clarity and showing the cartridge neck being flared.
FIG. 6 is an elevation view of the priming tool of the cartridge reloading tool of the invention.
FIG. 7 is a view similar to FIGS. 2 and 3 but showing the flared cartridge containing a new primer and charged with gunpowder.
FIG. 8 is a view similar to FIG. 7 and further including a cross section elevation view of the bullet seater of the invention seating a bullet in a cartridge.
FIG. 9 is a cross section elevation view of the flaring and crimping tool shown in FIG. 5 and showing the shell neck of a cartridge being crimped around a bullet.
Figure 11:
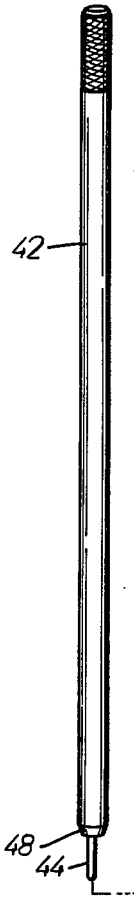
FIG. 11 is an exploded perspective view of the apparatus shown in FIG. 8 and further showing the depriming tool.
Figure 11:
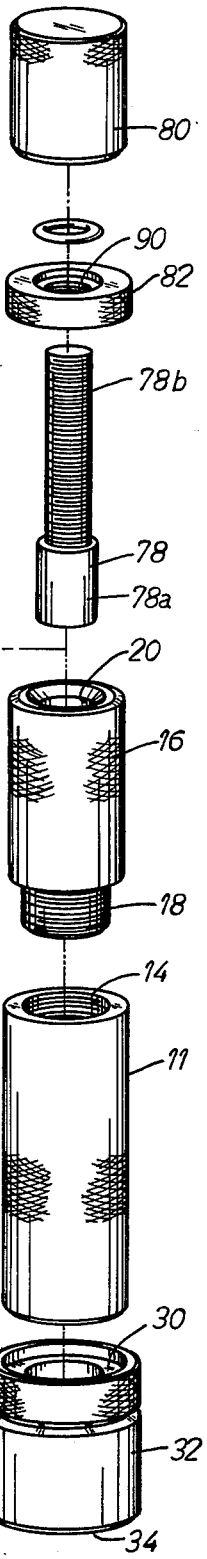
Figure 12:
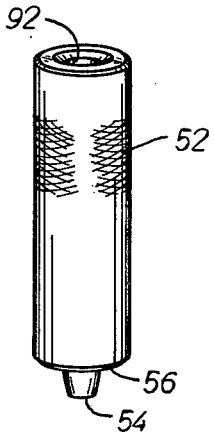
FIG. 12 is a perspective view of the flaring and crimping tool.
Figure 10:
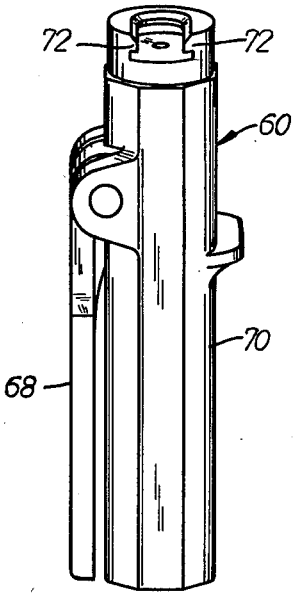
FIG. 10 is a perspective view of the priming tool shown in FIG. 6.

Referring to FIG. 5, a crimping and flaring tool 52 is shown for use in flaring the mouth of the cartridge C, to facilitate insertion of a bullet into the cartridge neck during a later step. The crimping and flaring tool 52 is a generally cylindrical metal body including a tapered and rounded flaring projection 54 extending from one end thereof. The tapered flaring projection 54 is generally cylindrical but tapers and is rounded toward its free end. The outside diameter of the free end of the flaring projection 54 is slightly smaller than the inside diameter of the cartridge neck and is intended to be received therein. In operation, the cartridge C is supported on its base and the free end of the flaring projection is received in the cartridge neck. The flaring and crimping tool 52 is then tapped with a mallet or the like until the projection 54 is received completely in the cartridge neck and the end of the cartridge is positioned against the shoulder 56 at the end of the flaring tool 52. The diameter of the tapered projection 54 of the flaring tool 52 increases toward the shoulder 56. As a result, as the projection 54 is driven into the neck of the cartridge C, the neck is forced to expand.

The next step in the reloading process, using the reloading apparatus of the invention, includes forcing a new primer into the primer bore in the base of the cartridge C as shown in FIG. 6. The cartridge C is placed in the cartridge holder 58 of a priming tool 60 of the type more clearly shown and described in U.S. Pat. No. 4,142,441 issued Mar. 6, 1979 to Schaenzer. The priming tool 60 generally includes a central longitudinal bore 62 in its upper end for holding a new primer 64. An axially moveable pin 66 is located in the longitudinal bore 62 and supports the new primer 64. The lower end of the moveable pin is operably connected to a lever 68 in such a manner that, as the lower end of the lever 68 is forced toward the body 70 of the priming tool, the slideable pin is caused to move upwardly forcing the primer 64 into the primer bore of the cartridge C. The cartridge C is restrained against movement by the inwardly projecting flanges 72 of the cartridge holder 58 of the priming tool 60.

The subsequent step in reloading a cartridge using the reloading apparatus of the invention comprises placing the base of the cartridge C in the central bore 38 of the anvil 32 and placing the resizing die 10 over the cartridge C such that the lower end of the resizing die 10 rests on the circular seat 30 of the anvil 32 as shown in FIG. 7. The desired measured quantity of gunpowder can then be poured into the enlarged funnel portion 26 of the resizing die and into the cartridge C. A bullet 74 can then be manually positioned in the cartridge neck.

FIG. 8 illustrates the next step of reloading the cartridge wherein the bullet is foreced into the cartridge neck the required distance using a bullet seating assembly 76. The bullet seating assembly 76 is comprised of a threaded bullet seating stem 78, a handle 80 and a lock nut 82. The bullet seating stem is generally cylindrical and its lower end 78*a* is slightly smaller than the diameter of the bore 26 in the resizing die 10 and is slideably received therein. The lower end 78*a* of the bullet seating stem includes a longitudinally extending bore 84 having an outwardly tapered portion 86 for receiving the upper end of a bullet as shown in FIG. 8. The upper end 78*b* of the bullet seating stem 78 is threaded and smaller in diameter than the lower end 78*a*. The handle 80 is generally cylindrical and includes a central threaded longitudinal bore 88, the bore 88 being open at the lower end of the handle 80 and threadably receiving the upper end 78*b* of the bullet seating stem 78. The lock nut 82 includes a central threaded bore 90 for threadably receiving the upper end 78*b* of the bullet seating stem 78 and can be tightened against the lower surface of the handle 80 to prevent relative movement between the handle 80 and the bullet seating stem.

In operation, when the bullet seating stem 78 is received in the bore 26 of resizing die 10 and engages a bullet located in the cartridge neck, the handle 80 is tapped with a mallet or the like forcing the bullet into the cartridge neck. The handle 80 and lock nut 82 are threadably adjustable on the bullet seating stem 78 to permit adjustment of the depth the bullet is forced into the cartridge neck. When the bullet has been fully seated, the lock nut 82 engages the upper surface of the resizing die 10.

As a final step of the cartridge reloading operation, the shell neck is crimped around the bullet 74 using the crimping and flaring tool 52 in the manner shown in FIG. 9. The end of the crimping and flaring tool 52 opposite the flaring projection 54 includes a concentric stepped bore 92 having an outer portion 93 having a diameter substantially equal to that of the desired diameter of the neck of a reloaded cartridge and concentric inner portion 94 for receiving the bullet. A tapered shoulder portion 96 is located between the outer bore portion 93 and the concentric smaller diameter portion 94. During the final step of the cartridge reloading operation, the crimping tool 52 is placed over the bullet and the cartridge neck and tapped with a mallet such that the outer portion 93 of bore 93 is forced down over the cartridge neck. When the flaring and crimping tool is forced onto the cartridge completely, the shoulder portion 96 of bore 90 will crimp the rim of the cartridge neck against the bullet.

I claim:

1. A cartridge reloading apparatus comprising:

a resizing die having a longitudinal bore formed therein which includes a funnel portion, and a coaxial resizing portion for receiving a used cartridge therein and for reshaping the external configuration of a cartridge driven therein by mechanical force; an anvil for supporting said resizing die, said anvil including a bore therein having a diameter larger than the diameter of said cartridge and for receiving a portion of said cartridge; means for removing the primer from said cartridge by mechanical force and for forcing said cartridge out of said resizing die while said resizing die is seated on said anvil, the removing means being a rod including an end receivable in said cartridge and supporting a pin extending axially from said end for striking said primer; cartridge priming means for forcing a primer into said cartridge; means for flaring the neck opening of said cartridge to form a funnel which cooperates with the funnel portion of said resizing die to facilitate filling said cartridge with gunpowder and to facilitate the insertion of a bullet therein; a bullet seating tool for forcing a bullet into said shell neck; and crimping means for crimping said neck against said bullet.

2. The cartridge reloading apparatus set forth in claim 1, wherein said cartridge priming means includes a body having a chamber for restraining an end of a cartridge and a central bore communicating with the chamber and for receiving a primer therein and means for forcing said primer into said cartridge.

3. The cartridge reloading apparatus set forth in claim 1 wherein said means for flaring the neck opening of said cartridge includes a body having opposite ends, a tapered flaring projection extending from one of said ends, said tapered flaring projection being adapted to have a portion thereof received in said neck portion for flaring said neck portion when driven into said neck by mechanical force.

4. The cartridge reloading apparatus set forth in claim 3 wherein said body further includes a longitudinal bore in the other of said ends for comprising said crimping means, said longitudinal bore including a first portion adjacent said other of said ends and for receiving said shell neck therein and a second portion having a diameter smaller than the diameter of said first portion and for receiving a portion of said bullet, and said longitudinal bore including a shoulder portion joining said first and second portions and adapted to crimp said neck against said bullet when said bullet and cartridge are driven into said longitudinal bore.

5. The cartridge reloading apparatus set forth in claim 4 wherein said cartridge priming means includes a body having a chamber for restraining an end of a cartridge and a central bore communicating with the chamber and for receiving a primer therein and means for forcing said primer into said cartridge.

6. A method for reloading a centerfire cartridge including a cartridge case having an open neck and having a base housing a primer, the method comprising the steps of: resizing the external configuration of a used cartridge by driving the used cartridge into a longitudinal bore of a resizing die using mechanical force; positioning the resizing die, having the used cartridge therein, on an anvil having a central bore therein, said central bore having a diameter larger than the diameter of the cartridge; inserting an end of a primer removing rod into the cartridge neck, said rod having a pin extending from said end for knocking said primer out of said cartridge; striking said primer with said pin of the primer removing rod; forcing said used cartridge out of said resizing die with said primer removing rod; flaring the neck of said cartridge to form a funnel; forcing a new primer into said cartridge; placing the flared neck of said cartridge within the longitudinal bore of said die, said longitudinal bore having a funnel portion formed therein which cooperates with said flared neck to facilitate filling said cartridge with gunpowder and insertion of a bullet therein; filling said cartridge with gunpowder; inserting a bullet into said cartridge neck; and crimping said cartridge neck around said bullet.

* * * * *